US012606991B2

(12) United States Patent
Howells

(10) Patent No.: US 12,606,991 B2
(45) Date of Patent: Apr. 21, 2026

(54) WORKING MACHINE

(71) Applicant: J. C. Bamford Excavators Limited, Uttoxeter (GB)

(72) Inventor: Richard Howells, Uttoxeter (GB)

(73) Assignee: J.C. Bamford Excavators Limited, Uttoxeter (GB)

( * ) Notice: Subject to any disclaimer, the term of this patent is extended or adjusted under 35 U.S.C. 154(b) by 218 days.

(21) Appl. No.: 17/938,918

(22) Filed: Sep. 6, 2022

(65) Prior Publication Data

US 2023/0074065 A1 Mar. 9, 2023

(30) Foreign Application Priority Data

Sep. 6, 2021 (GB) ..... 2112660

(51) Int. Cl.
*E02F 9/26* (2006.01)
*E02F 9/08* (2006.01)
(Continued)

(52) U.S. Cl.
CPC ..... *E02F 9/261* (2013.01); *E02F 9/085* (2013.01); *E02F 9/0858* (2013.01); *E02F 9/2033* (2013.01); *E02F 9/24* (2013.01)

(58) Field of Classification Search
CPC ..... E02F 9/261; E02F 9/085; E02F 9/0858; E02F 9/2033; E02F 9/24; B60T 7/22;
(Continued)

(56) References Cited

U.S. PATENT DOCUMENTS 10,007,269 B1 * 6/2018 Gray ..... G06F 18/2178
11,847,562 B2 * 12/2023 Ogata ..... G06F 18/217
(Continued)

FOREIGN PATENT DOCUMENTS

CN 113266045 A 8/2021
EP 2874851 A1 5/2015
(Continued)

OTHER PUBLICATIONS

JP2010198519A-Description Translation Title: Periphery Monitoring Device Author: Konuma et al. Date: Sep. 9, 2010 (Year: 2025).*
(Continued)

*Primary Examiner* — Khoi H Tran
*Assistant Examiner* — Trang Dang
(74) *Attorney, Agent, or Firm* — MARSHALL, GERSTEIN & BORUN LLP

(57) ABSTRACT

A working machine includes a body, a ground engaging propulsion structure supporting the body, a working arm, a control system, and a collision avoidance system. The collision avoidance system has a camera configured to monitor an area in its field of view and to generate an output signal to the control system in response to a detected animate object. The control system includes a processor configured to execute a machine learning algorithm trained to determine whether the detected object is an animate object to determine whether an animate object is within the field of view. The system provides an output to alert an operator of the working machine if it is determined that an animate object has been detected in the field of view of the at least one camera.

18 Claims, 6 Drawing Sheets

(51) Int. Cl.
*E02F 9/20* (2006.01)
*E02F 9/24* (2006.01)

(58) Field of Classification Search
CPC ..... B60T 2210/32; B60T 2210/34; B60W 30/09; B60W 50/14; B60W 2554/40; G08G 1/166
See application file for complete search history.

(56) References Cited

U.S. PATENT DOCUMENTS

| | | | | |
|---|---|---|---|---|
| 12,320,096 | B2 * | 6/2025 | Kurosawa | E02F 9/262 |
| 2010/0204873 | A1 * | 8/2010 | Lee | B60R 1/26 348/148 |
| 2018/0258616 | A1 * | 9/2018 | Kiyota | G06T 1/00 |
| 2019/0028676 | A1 * | 1/2019 | Koga | G06Q 50/08 |
| 2019/0093318 | A1 * | 3/2019 | Izumikawa | E02F 9/2033 |
| 2019/0360177 | A1 * | 11/2019 | Kiyota | B60R 1/23 |
| 2020/0149248 | A1 * | 5/2020 | Ram-On | E01C 19/004 |
| 2021/0010243 | A1 * | 1/2021 | Fukuoka | B60Q 5/006 |
| 2021/0298220 | A1 * | 9/2021 | Kean | A01B 69/004 |
| 2021/0304708 | A1 * | 9/2021 | Matsushita | B60K 35/10 |
| 2021/0310219 | A1 * | 10/2021 | Aizawa | E02F 3/437 |
| 2021/0387650 | A1 * | 12/2021 | Li | B60W 50/14 |
| 2022/0106765 | A1 * | 4/2022 | Sasaki | E02F 9/16 |
| 2022/0154423 | A1 * | 5/2022 | Bruflodt | E02F 9/261 |
| 2022/0213669 | A1 * | 7/2022 | Eguchi | H04N 7/18 |
| 2023/0001854 | A1 * | 1/2023 | Bruflodt | B60R 1/23 |
| 2023/0005356 | A1 * | 1/2023 | Maley | G08B 3/10 |

FOREIGN PATENT DOCUMENTS

| | | | | | |
|---|---|---|---|---|---|
| EP | 3165406 | A1 | | 5/2017 | |
| EP | 3480374 | A1 | | 5/2019 | |
| JP | 2009 121053 | A | | 6/2009 | |
| JP | 2010198519 | A | * | 9/2010 | E02F 9/24 |
| JP | 2018123646 | A | * | 8/2018 | |
| JP | 6878025 | B2 | | 5/2021 | |
| KR | 20150123534 | A | | 11/2015 | |
| KR | 20190104783 | A | | 9/2019 | |
| KR | 102102857 | B1 | | 4/2020 | |
| WO | WO-2021/111839 | A1 | | 6/2021 | |

OTHER PUBLICATIONS

JP2018123646A Periphery Monitoring System for Work Machine Author: Aizawa Susumu, Otsuki Shunsuke Publication date: Aug. 9, 2018 (Year: 2018).*

Extended European Search Report issued in EP Application No. 22194101.6, dated Jan. 30, 2023.

Search Report for GB 2112660.2, dated Dec. 20, 2021.

* cited by examiner

WORKING MACHINE

FIELD

The present teachings relate to a working machine.

BACKGROUND

Off-highway vehicles or working machines are for example those used in construction industries configured to transport loads over a surface (e.g. backhoe loaders, slew excavators telescopic handlers, forklifts, skid-steer loaders). One such working machine is a telescopic handler, often referred to as telehandlers or rotating telehandlers, are that are typically used to lift, move and place material or cargo.

These working machines typically have a working arm pivotally mounted to the body of the machine, and a working implement, such as a bucket or a grabber, attached to the end of the arm via a coupling device. Attachment of the working implement enables the working machine to perform a variety of tasks on a work site.

Some of these tasks involve moving between and stopping at certain locations within a worksite, and, because of the visibility provided to operators of the machines, it can be difficult to be aware of the positions of any workers or animals on the worksite, which can result in collisions between the machine and a worker. It has been found that a large portion of these collision incidents occur during: reversing the machine, slow speed maneuvers, loading and unloading of a load, and coupling and uncoupling of a working implement such as a bucket or forks.

The present teachings seek to overcome or at least mitigate one or more problems associated with the prior art.

SUMMARY

A first aspect of the teachings provides a working machine comprising: a body; a ground engaging propulsion structure supporting the body; a working arm mounted to the body; a control system; and a collision avoidance system comprising at least one camera mounted on the body of the working machine and configured to monitor an area in its field of view and to generate an output signal to the control system in response to a detected animate object in said field of view, wherein the control system comprises a processor configured to execute a machine learning algorithm trained to determine whether the detected animate object is an animate object to determine whether an animate object is within the field of view of the at least one camera from the sensor output signal, wherein the control system is configured to provide an output if it is determined that an animate object has been detected in the field of view of the at least one camera.

The working machine may comprise a plurality of cameras mounted on the body of the working machine The machine learning algorithm is able to reliably determine whether or not an object in the field of view of the one or more cameras is an animate objection. Hence, the use of the machine learning algorithm to determine whether or not an object in a camera's field of view helps to improve the reliability of the collision avoidance system.

In this way, the working machine is provided with a control system that is able to identify that a person or animal is located near to the working machine and to provide an output in response to this determination. Thus, the present collision avoidance system helps to reduce the risk of a collision between a working machine and an animate object The machine learning algorithm may comprise a neural network.

A neural network has been found to be particularly accurate at identifying an animate object.

The machine learning algorithm is capable of performing pattern recognition to determine whether the detected object is an animate object based on this pattern recognition.

The output may be an alert to alert an operator of the working machine.

The alert may comprise an indicator, an alarm, a display, or another device.

The output from the control system may comprise activating an indicator or activating an alarm. The working machine may comprise an array of indicators, e.g. lights or speakers, arranged within an operator cab, and wherein the control system may be configured to indicate a position of the detected animate object relative to the operator cab via the array of indicators.

This arrangement of indicators in an operator cab has been found to quickly and effectively relay the position of the detected animate object to an operator of the working machine.

The indicators may be arranged within the cab such that at least one indicator is positioned at each of front, rear, right side and left side positions of the cab.

The working machine may comprise a display configured to display the camera outputs from the plurality of cameras, wherein the control system may be configured to divide the camera outputs into a plurality of zones independently of the mounted positions of the cameras, to assign the camera outputs to said zones, and to display at least one zone on the display.

The indicators may be arranged within the operator cab such that an indicator is positioned within the cab proximate to each zone.

The control system may be configured to provide an output for alerting an operator if it is determined that an animate object has been detected in at least one zone.

When an animate object is detected in a zone and is determined to be at a greater distance from the working machine than a predetermined threshold distance, the control system may be configured to provide a first, or low, risk warning, and when an animate object is detected within a zone and is determined to be within a predetermined distance from the working machine, the control system may be configured to provide a second, or high, risk waring.

When it is determined that an animate object has been detected in at least two zones, the control system may be configured to assign a collision risk level to each detected animate object and to prioritize the zone or zones to display on the display based on the assigned collision risk levels.

The control system may be configured to prioritize the zone to display based on one or more of: a position of the detected animate object relative to a direction of travel of the working machine; a proximity of the detected animate object to the working machine; a most recently detected animate object; and/or a number of animate objects detected in each danger zone.

The control system may be configured to assign a first, or highest, level of priority to zone based on a position of the detected animate object relative to a direction of travel of the working machine.

The direction of travel of the working machine may be based on a selected state of a forward/neutral/reverse (FNR) drive selector; and/or an angular position of a steering wheel.

The control system may be configured to assign a second level of priority, below the first level of priority, based on a proximity of the detected animate objects to the working machine.

When more than one of the plurality of cameras detect animate objects within a predetermined distance from the working machine, the control system may be configured to prioritize the camera output signal to display based on the highest number of animate objects detected within said predetermined distance.

The control system may be configured to assign a third level of priority, below the second level of priority, based on a most recent detection of an animate object.

The control system may be configured to assign a fourth level of priority, below the third level of priority, based on a total number of animate objects detected in a zone.

The control system may be configured to provide a warning, alert, or notification on the display in relation to a detected animate object not displayed on the display.

The working machine may comprise a plurality of cameras mounted on the body of the working machine and configured to monitor an area in their respective field of view and to generate an output signal to the control system in response to a detected animate object in said field of view, wherein the cameras are configured and arranged so as to a 360° field of view around the working machine.

The field of view of adjacent cameras overlap.

This arrangement enables the cameras to maintain a full 360° field of view when one or more of the cameras are knocked/moved (i.e. when one or more of the cameras is moved out of alignment). This helps to reduce the risk of a collision between a working machine and an animate object.

The working machine may comprise four cameras each with a field of view of greater than 90°, e.g. each with a field of view of approximate 170° degrees.

The control system may be configured to stitch the images from the plurality of cameras together to provide a 360° visual representation on a display.

When it is determined that an animate object has been detected in the field of view of at least two of the plurality of cameras, the control system may be configured to select a camera output signal from one or more of the at least two cameras to display on a display.

The camera output signal to be displayed may be selected based on one or more of: the direction of movement of the working machine; the proximity of the animate objects detected by the cameras; the most recently detected animate object; the determined trajectory of the detected animate object; and/or the number of animate objects detected by each camera.

The working machine may comprise a display configured to operate in a plurality of display modes comprising a camera display mode in which the display is configured to display an output from one or more of the plurality of cameras and at least one other display mode, wherein, when it is determined that an animate object has been detected in the field of view of the at least one camera, the control system may be configured to override the selection of the at least one other display mode to activate the camera display mode.

The control system may be configured to override the selection of the at least one other display mode to activate the camera display mode to display at least one zone on the display.

The working machine may comprise a first override control such that one or more of the plurality of cameras can be deactivated by an operator of the working machine via the control system.

The first override control may be configured to deactivate a zone.

The working machine may comprise an operator cab mounted on the body so as to be offset from a center of the body, wherein only the camera(s) and/or zone on a side of the working machine proximate to the operator cab can be deactivated.

The working machine may comprise a second override control such that an output generated in response to an animate object being detected is able to be deactivated.

The working machine may comprise an operator input, wherein the control system comprises a memory, and wherein, in use, an operator of the working machine can input a failure to detect an animate object and/or an incorrect determination of a detected animate object so as to be stored on the memory.

The control system may be configured to provide a gradual stop of the working machine if it is determined that an animate object has been detected, and wherein the control system is configured to provide a rate of gradual stop based on one or more of: a load carried by the working arm; and/or the position of the working arm.

The body may comprise an undercarriage and a superstructure rotatably mounted on the undercarriage, wherein the plurality of cameras are mounted on the rotatable superstructure or the undercarriage, and wherein the control system may be configured to select, e.g. via an operator input, whether displayed zones remain fixed relative to the undercarriage or remain fixed relative to the superstructure.

The working machine may comprise a chassis comprising front and rear chassis that are pivotable relative to each other, and wherein the control system is configured to define a zone to an area between the front and rear chassis.

According to a second aspect of the teachings, there is provided a working machine comprising: a body; a ground engaging propulsion structure supporting the body; a working arm mounted to the body; a display; a control system; and a collision avoidance system comprising a plurality of cameras mounted on the body of the working machine and configured to monitor an area in its field of view and to generate a camera output signal to the control system, wherein the control system is configured to define a plurality zones, to assign the outputs of the plurality of cameras to the plurality of zones, and to display one or more of the zones on the display, and wherein the control system is configured to provide an output for alerting an operator if it is determined that an animate object has been detected in at least one zone.

The plurality of zones may be defined independently of the mounted positions of the cameras.

The plurality of zones may be defined in relation to one or more of the group comprising the front, a first side, a second side and rear of the working machine.

The body may comprise an undercarriage and a superstructure rotatably mounted on the undercarriage and the front, first and second sides and rear are with respect to the undercarriage or superstructure, optionally, via an operator input.

The output may be an alert to alert an operator of the working machine.

The alert may comprise an indicator, an alarm, a display, or another device.

The output from the control system may comprise activating an indicator or activating an alarm. The working machine may comprise an array of indicators, e.g. lights or speakers, arranged within an operator cab, and wherein the control system may be configured to indicate a position of the detected animate object relative to the operator cab via the array of indicators.

This arrangement of indicators in an operator cab has been found to quickly and effectively relay the position of the detected animate object to an operator of the working machine.

The indicators may be arranged within the cab such that at least one indicator is positioned at each of front, rear, right side and left side positions of the cab.

The working machine may comprise a display configured to display the camera outputs from the plurality of cameras, wherein the control system may be configured to divide the camera outputs into a plurality of zones independently of the mounted positions of the cameras, to assign the camera outputs to said zones, and to display at least one zone on the display.

The indicators may be arranged within the operator cab such that an indicator is positioned within the cab proximate to each zone.

The control system may be configured to provide an output for alerting an operator if it is determined that an animate object has been detected in at least one zone.

When an animate object is detected in a zone and is determined to be at a greater distance from the working machine than a predetermined threshold distance, the control system may be configured to provide a first, or low, risk warning, and when an animate object is detected within a zone and is determined to be within a predetermined distance from the working machine, the control system may be configured to provide a second, or high, risk waring.

When it is determined that an animate object has been detected in at least two zones, the control system may be configured to assign a collision risk level to each detected animate object and to prioritize the zone or zones to display on the display based on the assigned collision risk levels.

The control system may be configured to prioritize the zone to display based on one or more of: a position of the detected animate object relative to a direction of travel of the working machine; a proximity of the detected animate object to the working machine; a most recently detected animate object; and/or a number of animate objects detected in each danger zone.

The control system may be configured to assign a first, or highest, level of priority to zone based on a position of the detected animate object relative to a direction of travel of the working machine.

The direction of travel of the working machine may be based on a selected state of a forward/neutral/reverse (FNR) drive selector; and/or an angular position of a steering wheel.

The control system may be configured to assign a second level of priority, below the first level of priority, based on a proximity of the detected animate objects to the working machine.

When more than one of the plurality of cameras detect animate objects within a predetermined distance from the working machine, the control system may be configured to prioritize the camera output signal to display based on the highest number of animate objects detected within said predetermined distance.

The control system may be configured to assign a third level of priority, below the second level of priority, based on a most recent detection of an animate object.

The control system may be configured to assign a fourth level of priority, below the third level of priority, based on a total number of animate objects detected in a zone.

The control system may be configured to provide a warning, alert, or notification on the display in relation to a detected animate object not displayed on the display.

The working machine may comprise a plurality of cameras mounted on the body of the working machine and configured to monitor an area in their respective field of view and to generate an output signal to the control system in response to a detected animate object in said field of view, wherein the cameras are configured and arranged so as to a 360° field of view around the working machine.

The field of view of adjacent cameras overlap.

This arrangement enables the cameras to maintain a full 360° field of view when one or more of the cameras are knocked/moved (i.e. when one or more of the cameras is moved out of alignment). This helps to reduce the risk of a collision between a working machine and an animate object.

The working machine may comprise four cameras each with a field of view of greater than 90°, e.g. each with a field of view of approximate 170° degrees.

The control system may be configured to stitch the images from the plurality of cameras together to provide a 360° visual representation on a display.

When it is determined that an animate object has been detected in the field of view of at least two of the plurality of cameras, the control system may be configured to select a camera output signal from one or more of the at least two cameras to display on a display.

The camera output signal to be displayed may be selected based on one or more of: the direction of movement of the working machine; the proximity of the animate objects detected by the cameras; the most recently detected animate object; the determined trajectory of the detected animate object; and/or the number of animate objects detected by each camera.

The working machine may comprise a display configured to operate in a plurality of display modes comprising a camera display mode in which the display is configured to display an output from one or more of the plurality of cameras and at least one other display mode, wherein, when it is determined that an animate object has been detected in the field of view of the at least one camera, the control system may be configured to override the selection of the at least one other display mode to activate the camera display mode.

The control system may be configured to override the selection of the at least one other display mode to activate the camera display mode to display at least one zone on the display.

The working machine may comprise a first override control such that one or more of the plurality of cameras can be deactivated by an operator of the working machine via the control system.

The first override control may be configured to deactivate a zone.

The working machine may comprise an operator cab mounted on the body so as to be offset from a center of the body, wherein only the camera(s) and/or zone on a side of the working machine proximate to the operator cab can be deactivated.

The working machine may comprise a second override control such that an output generated in response to an animate object being detected is able to be deactivated.

The working machine may comprise an operator input, wherein the control system comprises a memory, and wherein, in use, an operator of the working machine can input a failure to detect an animate object and/or an incorrect determination of a detected animate object so as to be stored on the memory.

The control system may be configured to provide a gradual stop of the working machine if it is determined that an animate object has been detected, and wherein the control system is configured to provide a rate of gradual stop based on one or more of: a load carried by the working arm; and/or the position of the working arm.

The body may comprise an undercarriage and a superstructure rotatably mounted on the undercarriage, wherein the plurality of cameras are mounted on the rotatable superstructure or the undercarriage, and wherein the control system may be configured to select, e.g. via an operator input, whether displayed zones remain fixed relative to the undercarriage or remain fixed relative to the superstructure.

The working machine may comprise a chassis comprising front and rear chassis that are pivotable relative to each other, and wherein the control system is configured to define a zone to an area between the front and rear chassis.

BRIEF DESCRIPTION OF THE DRAWINGS

Embodiments will now be described with reference to the accompanying drawings, in which.

DESCRIPTION

Figure 1:
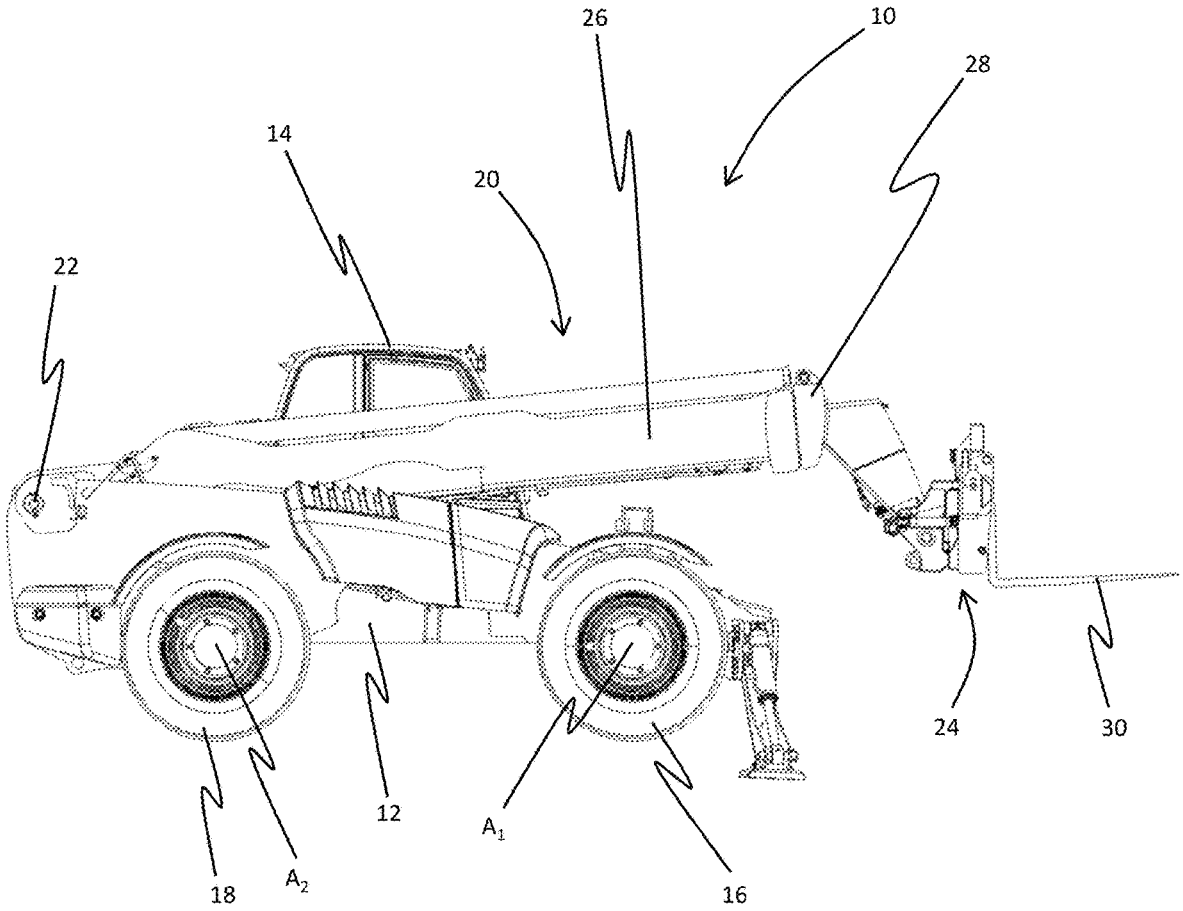
FIG. 1 is a schematic side view of a working machine according to an embodiment.

Referring firstly to FIG. 1, an embodiment of the teachings includes a working machine 10. The working machine may be a load handling machine. In this embodiment, the load handling machine 10 is a telescopic handler. In other embodiments the load handling machine 10 may be a rotating telescopic handler, a forklift, an excavator, a skid-steer loader, a compact track loader, a wheel loader, or a telescopic wheel loader, a tractor, for example. Such working machines may be denoted as off-highway vehicles or as non-road mobile machinery. The working machine 10 includes a machine body 12. The machine body 12 may include, for example, an operator's cab 14 from which an operator can operate the machine 10. The operator cab 14 may be mounted on the body 12 so as to be offset from a center of the body. Although in alternative arrangements, the cab 14 may be substantially central.

The working machine 10 has a ground engaging propulsion arrangement. The ground engaging propulsion arrangement or structure supports the body 12. A working arm 20 is pivotally connected to the body 12. The working arm 20 is connected to the body 12 by a mount 22 proximate a first end, or proximal end, of the working arm 20.

In some arrangements, the body 12 may include an undercarriage or chassis including the ground engaging propulsion arrangement, and a superstructure including the cab and arm, and the superstructure may be rotatable (e.g. about a substantially vertical axis) relative to the undercarriage/chassis. Put another way, the superstructure may be rotatable relative to the ground engaging propulsion structure. It will be appreciated that the mount 22 may be provided on the undercarriage/chassis or the superstructure.

The ground engaging propulsion structure includes a first, or front, axle A1 and a second, or rear, axle A2, each axle being coupled to a pair of wheels 16, 18. In other embodiments, the ground engaging propulsion structure may include a pair of endless tracks. One or both of the axles A1, A2 may be coupled to a drive arrangement (not shown) configured to drive movement of the ground engaging propulsion structure (i.e. the axles A1, A2). The drive arrangement causes movement of the working machine 10 over a ground surface. The drive arrangement includes a primer mover and a transmission. The prime mover may be an internal combustion engine, an electric motor, or may be a hybrid comprising both an internal combustion engine, an electric motor.

The working arm 20 may be a telescopic arm, having a first section 26 connected to the mount 22 and a second section 28 which is telescopically fitted to the first section 26. In this embodiment, the second section 28 of the working arm 20 is telescopically moveable with respect to the first section 26 such that the working arm 20 can be extended and retracted. Movement of the second section 28 with respect to the first section 26 of the working arm 20 may be achieved by use of an extension actuator (not shown), for example a double acting hydraulic linear actuator, an electric linear actuator, a telescopic extension ram, multiple extension rams, and/or a chain and pulley system. As will be appreciated, the working arm 20 may include a plurality of sections, for example two, three, four or more sections. Each arm section may be telescopically fitted to at least one other section, and an actuator may be provided therebetween. In alternative arrangements, the working arm 20 may not be telescopic and may include a first am pivotally mounted to the mount 22. In such arrangements, the working arm 20 may also include a second arm pivotally mounted to the first arm.

The working arm 20 can be moved with respect to the machine body 12 and the movement is preferably, at least in part, rotational movement about the mount 22. The rotational movement is about a substantially transverse axis of the machine 10. Rotational movement of the working arm 20 with respect to the machine body 12 is, in an embodiment, achieved by use of at least one lifting actuator (not shown) coupled between the arm 20 and the body 12.

A carriage assembly 24 is mounted to a second, or distal, end 21 of the working arm 20. A working implement, e.g. a load handling implement, 30 is mounted to the carriage assembly 24. The working machine 10 is configured to transport loads over uneven ground, i.e. with a load held by the working implement 30, an operator controls the ground engaging propulsion structure to move the machine 10 with the load from one location to another. In the illustrated arrangement, the working implement is a pair of forks 30, e.g. a pair of laterally spaced apart forks. The forks 30 project forwardly from the carriage assembly 24. In alternative arrangements, the working implement may be a bucket, or a basket etc., or any other suitable working implement.

Figure 2:
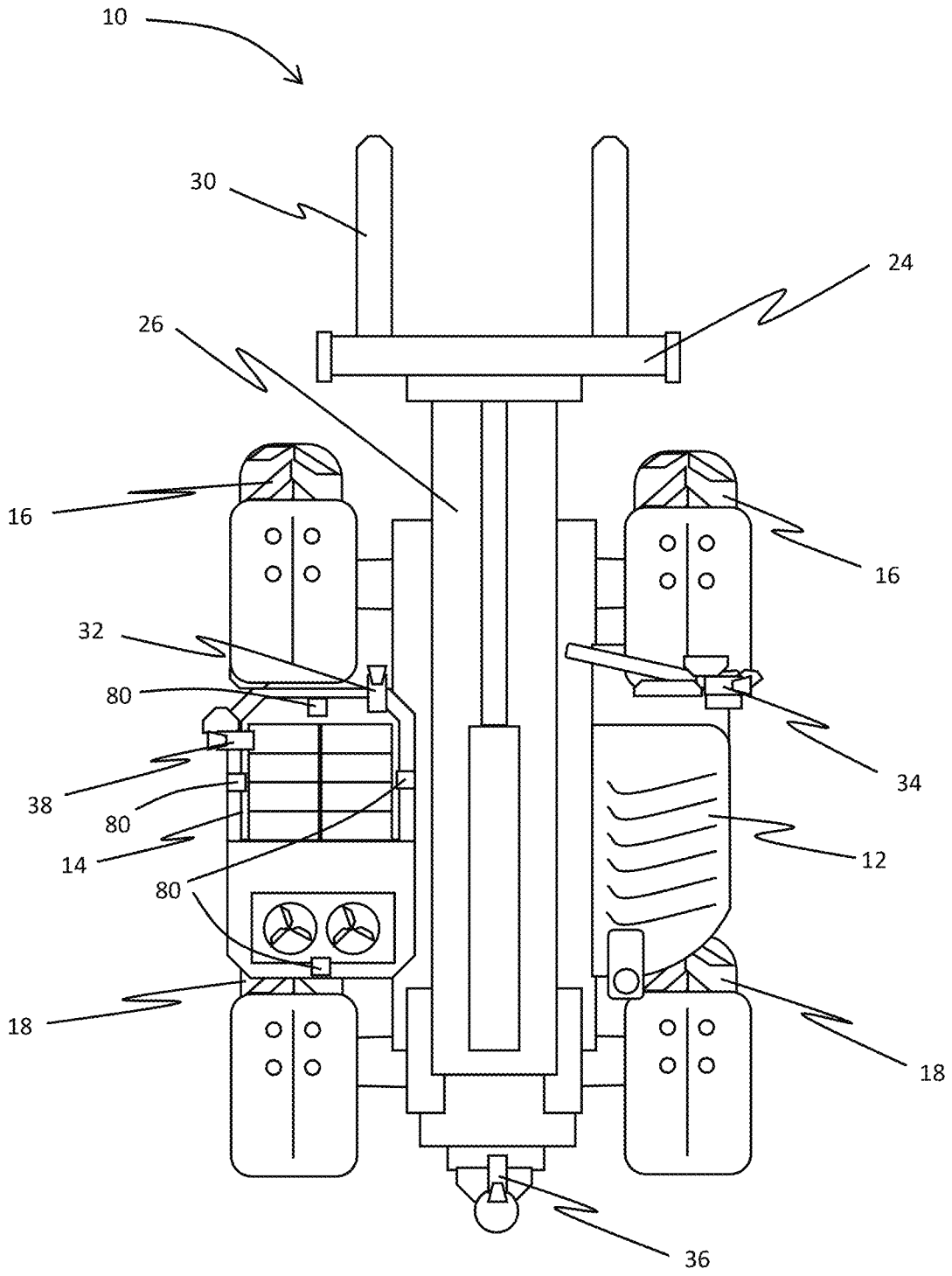
FIG. 2 is a schematic plan view of the working machine of FIG. 1.

Referring now to FIG. 2, the working machine 10 includes a collision avoidance system. The collision avoidance system includes at least one camera. In the arrangement shown, the collision avoidance system includes a plurality of cameras mounted on the body 12 of the working machine. The working machine 10 has four cameras mounted to the body 12. A first camera 32 is mounted at or near to a front of the working machine 10. A second camera 34 is mounted at or near a first side, e.g. a right side, of the working machine 10. The first side of the working machine 10 is a side of the working machine 10 that is remote from the operator cab 14. A third camera 36 is mounted at or near to a rear of the working machine 10. A fourth camera 38 is mounted at or near a second, e.g. left, side of the working machine 10. The second side of the working machine 10 is a side of the working machine 10 that is proximate to the operator cab 14. Although the working machine 10 has been illustrated with four cameras 32, 34, 36, 38, it will be appreciated that any suitable number of cameras may be used.

Figure 3:
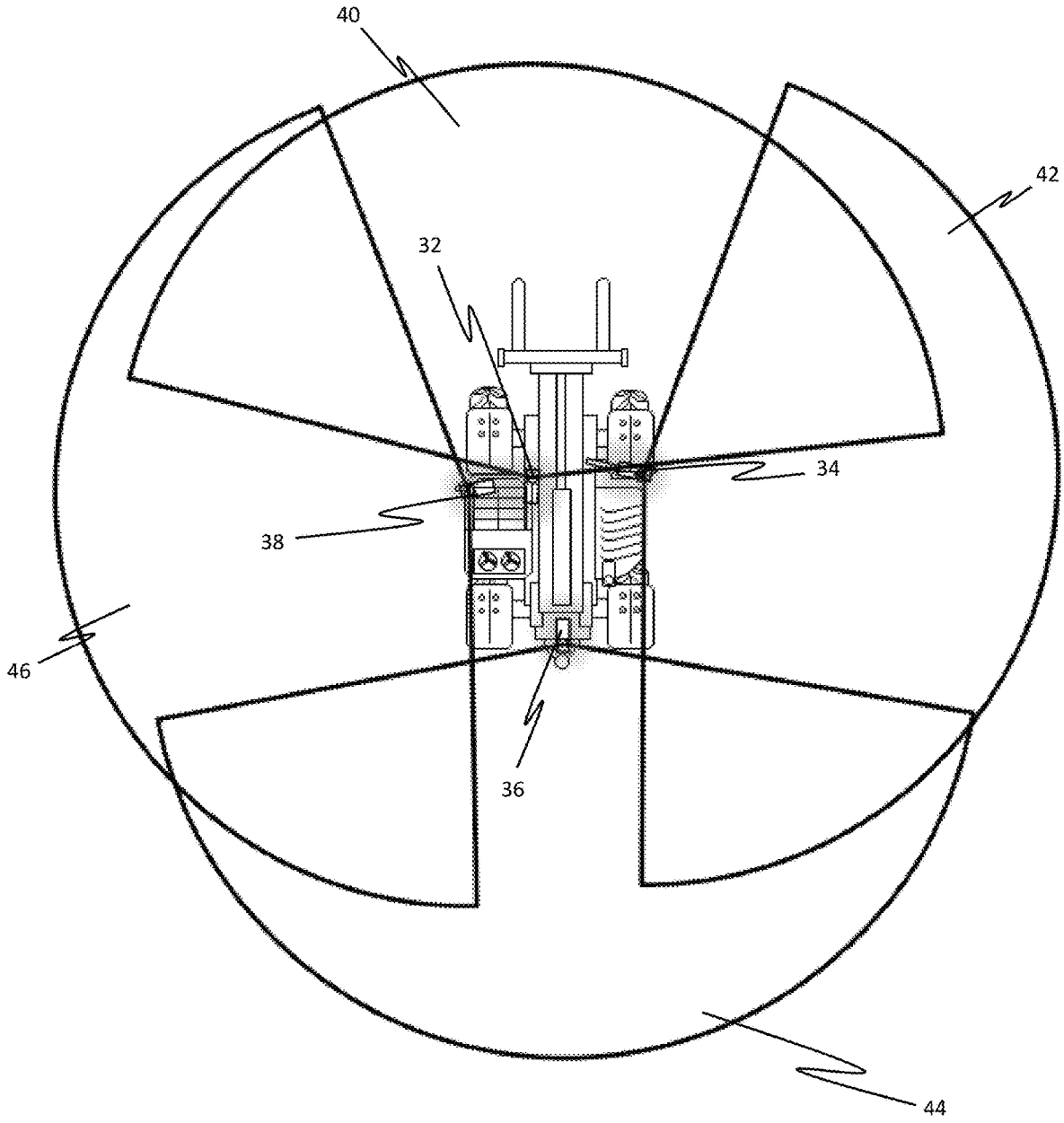
FIG. 3 is a schematic plan view of the working machine of FIG. 1 illustrating the field of view of the cameras.

Referring now to FIG. 3, each camera 32, 34, 36, 38 is configured to monitor an area in its respective field of view 40, 42, 44, 46. The one or more cameras 32, 34, 36, 38 may be arranged and configured so as to provide a 360° field of view around the working machine 10. Each camera 32, 34, 36, 38 relays the images of the monitored areas in the form of a camera output signal to a control system 76 (see FIG. 5). The camera output signals from the plurality of cameras 32, 34, 36, 38 are sent to the control system over a single stream. The control system is configured to generate an output signal for alerting an operator if it is determined that an animate object has been detected in the field of view of the at least one camera 32, 34, 36, 38. The output from the control system comprises activating an indicator, activating an alarm, and/or displaying one or more camera output signal on a display.

The working machine 10 includes a display. The display may be a touch screen display such that the display can be operated as an operator input. The display may be positioned within the operator cab 14. The display is configured to display the camera outputs from the plurality of cameras 32, 34, 36, 38, and the control system may be configured to divide the camera outputs into a plurality of zones, as is discussed in more detail below. The control system may be configured to assign the camera outputs to said zones, and to display at least one zone on the display.

It will be appreciated that the cameras 32, 34, 36, 38 may be mounted on the undercarriage or chassis of the working machine 10. In such arrangements, the fields of view 40, 42, 44, 46 of the cameras 32, 34, 36, 38 may be fixed relative to the undercarriage or chassis (e.g. in the event that that a superstructure is rotated relative to the undercarriage/chassis. It will also be appreciated that the cameras 32, 34, 36, 38 may be mounted on a superstructure (e.g. a rotatable superstructure). In these arrangements, the control system may be configured to enable an operator to select whether the fields of view 40, 42, 44, 46 of the cameras 32, 34, 36, 38 remains fixed relative to the undercarriage/chassis or remains fixed relative to the superstructure (i.e. fixed relative to the operator cab 14). In arrangements where the control system is configured to divide the camera outputs into a plurality of zones, the control system may be configured to select, e.g. via an operator input such as the touchscreen display, whether displayed zones remain fixed relative to the undercarriage or remain fixed relative to the superstructure.

The control system may be configured to restrict or inhibit movement of the working machine 10 in a direction towards a detected animate object, in response to a detected animate object in said field of view. It will be understood that the animate objects may be a pedestrian/person or an animal. The control system may be configured to prevent a change in a direction to travel of the working machine 10 and/or to apply brakes (not shown) to restrict or inhibit movement of the working machine 10 in a direction towards a detected animate object, in response to a detected animate object in said field of view. It will be appreciated that the control system is configured to restrict or inhibit movement of the working machine 10 in a direction towards a detected animate object whether the cameras 32, 34, 36, 38 are mounted on the undercarriage/chassis or a superstructure.

Restricting or inhibiting movement of the working machine 10 in a direction towards a detected animate object may be provided in the form of providing a gradual stop of the working machine 10, if it is determined that an animate object has been detected in the field of view of at least one camera 32, 34, 36, 38. The rate of the gradual stop may be based on one or more of: proximity of the detected animate object; the load carried by the working arm; vehicle speed; direction of travel of the working machine; and/or the position of the working arm. It will be appreciated that the direction of travel of the working machine 10 may be based on a selected state of a forward/neutral/reverse (FNR) drive selector (not shown), an angular position of a steering wheel (not shown), an angular orientation of the wheels, or any other suitable means.

The one or more cameras may also include a camera configured and arranged to monitor a field of view above the operator cab 14. The control system may be configured to define a zone corresponding to the area above the operator cab 14. The one or more cameras may also include a camera configured and arranged to monitor a field of view below a portion of the working arm 20. The one or more cameras may also include cameras to provide an operator with a view below the body of the working machine 10, and/or to provide a view of the rear end of the working machine 10, e.g. to provide improved visibility of a tow hitch or a three-point hitch (not shown). In arrangements where the body includes a chassis having front and rear chassis that are pivotable relative to each other, the one or more cameras may include a camera to monitor the area between the front and rear chassis. It will be appreciated that each of the front and rear chassis will be provided with a ground engaging propulsion structure. It will be appreciated that the control system may be configured to define a zone corresponding to one or more of these areas relative to the working machine.

The control system is configured to provide an output if it is determined that an animate object has been detected in the field of view of at least one camera 32, 34, 36, 38. The control system may be configured to provide an output for alerting an operator if it is determined that an animate object has been detected at least one zone. The output may be an override of one or more functions of the working machine 10. The output may be an alert to alert to alert an operator of the working machine 10. The alert may be an audio and or visual alert.

The control system may be configured to communicate that an animate object has been detected in the field of view of at least one camera 32, 34, 36, 38 to an indicator 80. The working machine may include an array of indicators 80, e.g. lights of speakers, within an operator cab 14. The control system may indicate a position of a detected animate object relative to the cab 14 via the array of indicators 80. For example, the cab 14 may include forward, right side, rear and left side indicators 80, and the control system may activate the indicator 80 corresponding to the side/region of the working machine 10 in which an animate object has been detected. In arrangements where the control system is configured to divide the camera outputs into a plurality of zones, the indicators 80 are arranged within the operator cab 14 such that an indicator 80 is positioned within the cab proximate to each zone.

When an animate object is detected in a zone and/or by a camera the control system may be configured to provide a first, or low, risk warning, and a second, or high, risk waring. The high and low risk warning may be alarms of different pitch or frequency (with higher pitch and/or frequency corresponding to a higher risk level). The high and low risk warnings may be provided in the form of different colored indicators, with a red indicator corresponding to a high risk level and an amber indicator corresponding to a low risk level.

The high risk level and low risk level may be based on a distance of a detected animate object away from the working machine 10. For example, when a detected animate object is determined to be at a greater distance from the working machine than a predetermined threshold distance, the control system may be configured to provide a first, or low, risk warning, and when an animate object is detected within a zone and is determined to be within a predetermined distance from the working machine, the control system may be configured to provide a second, or high, risk waring.

When it is determined that an animate object has been detected in the field of view of one or more of the plurality of cameras 32, 34, 36, 38, the control system is configured to select a camera output signal from one or more cameras to display on a display 60. If an animate object is only detected by one of the cameras 32, 34, 36, 38, then the camera output from that camera is displayed on the display. When it is determined that an animate object has been detected in at least two zones, the control system is configured to assign a collision risk level to each detected animate object and to prioritize the zone or zones to display on the display based on assigned collision risk levels.

The display 60 may be configured to operate in a plurality of display modes. The display modes may include a camera display mode in which the display is configured to display a camera output from one or more of the plurality of cameras 32, 34, 36, 38 and at least one other display mode. When it is determined that an animate object has been detected in the field of view of at least one camera 32, 34, 36, 38, the control system 76 may be configured to override the selection of the at least one other display mode to activate the camera display mode. When the control system is configured to divide the camera outputs into a plurality of zones and to assign the camera outputs to said zones, the control system may be configured to override the selection of the at least one other display mode to activate the camera display mode to display at least one zone on the display 60.

If an animate object is detected by more than one camera 32, 34, 36, 38, i.e. at least two cameras, the control system is configured to select the camera output to display based on one or more of: the direction of movement of the working machine; the proximity of the animate objects detected by the cameras; the most recently detected animate object; and/or the number of animated objects detected by each camera. 16. The control system 76 may be configured to provide a warning, alert, or notification on the display in relation to a detected animate object not displayed on the display. The notification may be provided in the form of an arrow, a flashing light, or any other suitable means.

In some arrangements, when an animate object is detected by more than one camera 32, 34, 36, 38, i.e. at least two cameras, and/or in more than one zone, the control system 76 may be configured to prioritize the camera output signal or signals from the at least two cameras 32, 34, 36, 38 to select a camera output signal (or a zone) to display on the display 60. The control system 76 may be configured to prioritize the camera output signal from the at least two cameras 32, 34, 36, 38 based on one or more of: a position of the detected animate object relative to a direction of travel of the working machine 10; a proximity of the detected animate object to the working machine 10; a most recently detected animate object; and/or a number of animate objects detected by each camera 32, 34, 36, 38.

In some arrangements, the control system 76 may be configured to assign a first, or highest, level of priority based on a position of the detected animate object relative to a direction of travel of the working machine 10. It will be appreciated that the direction of travel of the working machine 10 may be based on a selected state of a forward/neutral/reverse (FNR) drive selector (not shown), an angular position of a steering wheel (not shown), an angular orientation of the wheels, or any other suitable means. The FNR drive selector engages drive in a selected direction, or selects a neutral gear. The drive selector is configured to be operated by an operator of the working machine 10 to indicate an intended driving direction of the working machine 10, i.e. forward or reverse. The drive selector 50 may be located within the operator cab 14.

The control system may be configured to assign a second level of priority, below the first level of priority, based on a proximity of the detected animate objects to the working machine 10. When more than one of the plurality of cameras 32, 34, 36, 38 detect animate objects within a predetermined distance from the working machine 10, the control system 76 may be configured to prioritize the camera output signal to display on the display 60 based on the highest number of animate objects detected within said predetermined distance.

The control system 76 may be configured to assign a third level of priority, below the second level of priority, based on a most recent detection of an animate object. The control system 76 may be configured to assign a fourth level of priority, below the third level of priority, based on a total number of animate objects detected by each camera 32, 34, 36, 38.

It will be appreciated that the above prioritization levels may be changed by an operator. In some arrangements, this prioritization order may be changed via an operator input on the working machine, for example via the display. In alternative arrangements, this prioritization order may be changed by connecting a removable storage device, for example a USB interface to which a portable hard disk or memory stick may be connected, to a socket of the working machine, to transfer new prioritizations to the control system 76.

The control system may be configured to stitch the images from the plurality of cameras 32, 34, 36, 38 together to provide a 360° visual representation on the display. If one or more animate objects are detected by two or more adjacent cameras 32, 34, 36, 38, the control system may stitch the outputs from the cameras together and to display the output together on the display 60.

The field of views of the plurality of cameras provide a combined field of view greater than 360°. Put another way, the field of view of adjacent cameras 32, 34, 36, 38 overlap. This arrangement enables the cameras to maintain a full 360° field of view when one or more of the cameras 32, 34, 36, 38 a knocked/moved (i.e. when one or more of the cameras is moved out of alignment). In the illustrated arrangement, the four cameras 32, 34, 36, 38 each have a field of view of 170° degrees.

Figure 4:
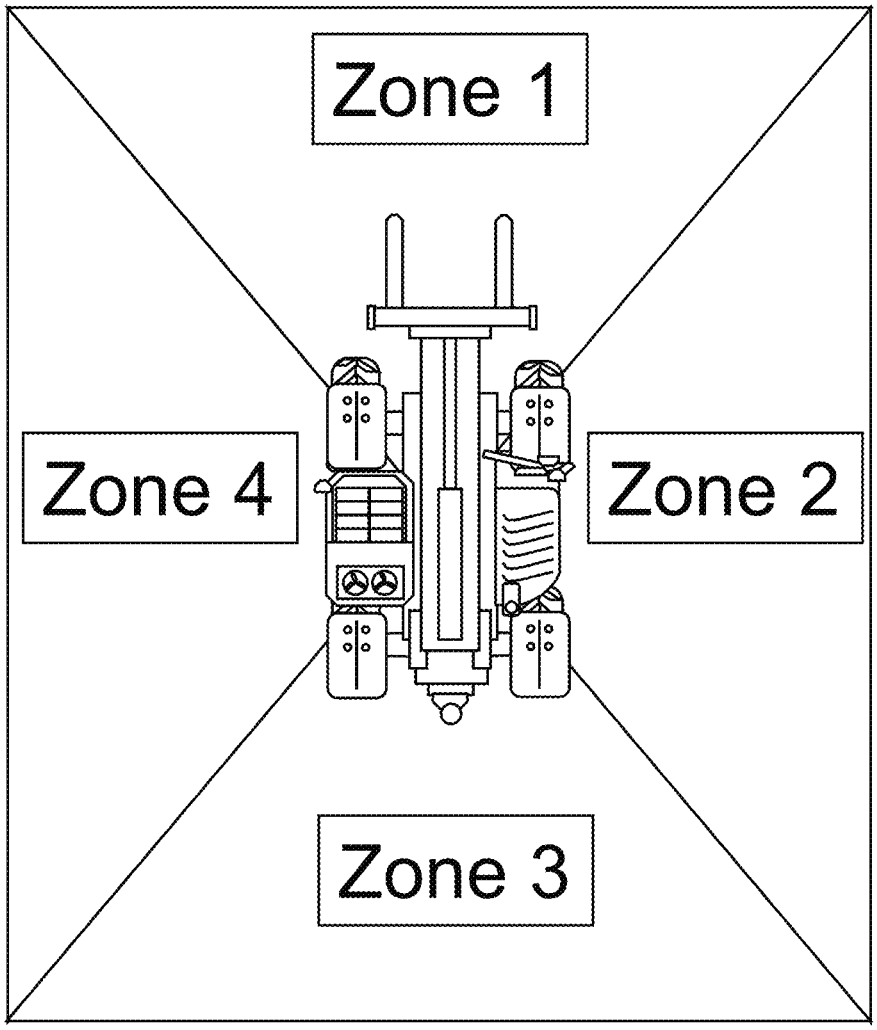
FIG. 4 is schematic plan view of the working machine of FIG. 1 illustrating the operational zones of the working machine.

Referring now to FIG. 4, the camera outputs from the one or more cameras 32, 34, 36, 38 may be divided up into four zones. It will be appreciated that any suitable number of zones maybe defined. A first zone 48 is at the front of the working machine 10. A second zone 50 is at a first, e.g. right, side of the working machine 10. The first side of the working machine 10 is a side of the working machine 10 that is remote from the operator cab 14. A third zone 52 is at the rear of the working machine 10. A fourth zone 54 is at a second, e.g. left, side of the working machine 10. The second side of the working machine 10 is a side of the working machine 10 that is proximate to the operator cab 14. In the illustrated arrangement, the four zones 48, 50, 52, 54 correspond to the fields of view 40, 42, 44, 46 of each of the cameras 32, 34, 36, 38. However, it will be appreciated that the plurality of zones are defined independently of the mounted positions of the cameras 32, 34, 36, 38.

The zones corresponding to the front, first and second sides and rear maybe defined with respect to the undercarriage or superstructure, optionally, via an operator input (such as the touchscreen display 60).

One or more of the cameras can be deactivated by an operator of the working machine 10 via the control system. The operator of the working machine 10 has an unobstructed view in the fourth zone 54 due to the position of the cab 14. In some arrangements, only the camera(s) or zone(s) monitoring a side of the working machine 10 proximate to the operator cab 14 can be deactivated. Put another way, in some arrangements, only the camera or cameras monitoring the fourth zone 54 can be deactivated. In such arrangements, the working machine 10 may include a first override control such that one or more of the plurality of cameras can be deactivated by an operator of the working machine 10 via the control system 76. It will be appreciated that the first override control may be operated via the touchscreen display 60, or via a separate display, switch or control. This arrangement can be advantageous when the working machine 10 is being operated with the assistance of a banksman, as it prevents the control system from preventing or inhibiting movement of the working machine 10 due to the presence of a banksman in this area/zone. In some arrangements, the control system can be overridden via a second override to deactivate an alert generated in response to an animate object being detected in the field of view of one or more of the cameras. In this arrangement, the camera (i.e. the monitored zone would remain active) but the control system 76 is configured to track or follow the deactivated animate object within the zone and to not generate an output based on this detected animate object. It will be appreciated that the second override control may be operated via the touchscreen display 60, or via a separate display, switch or control.

Figure 5:
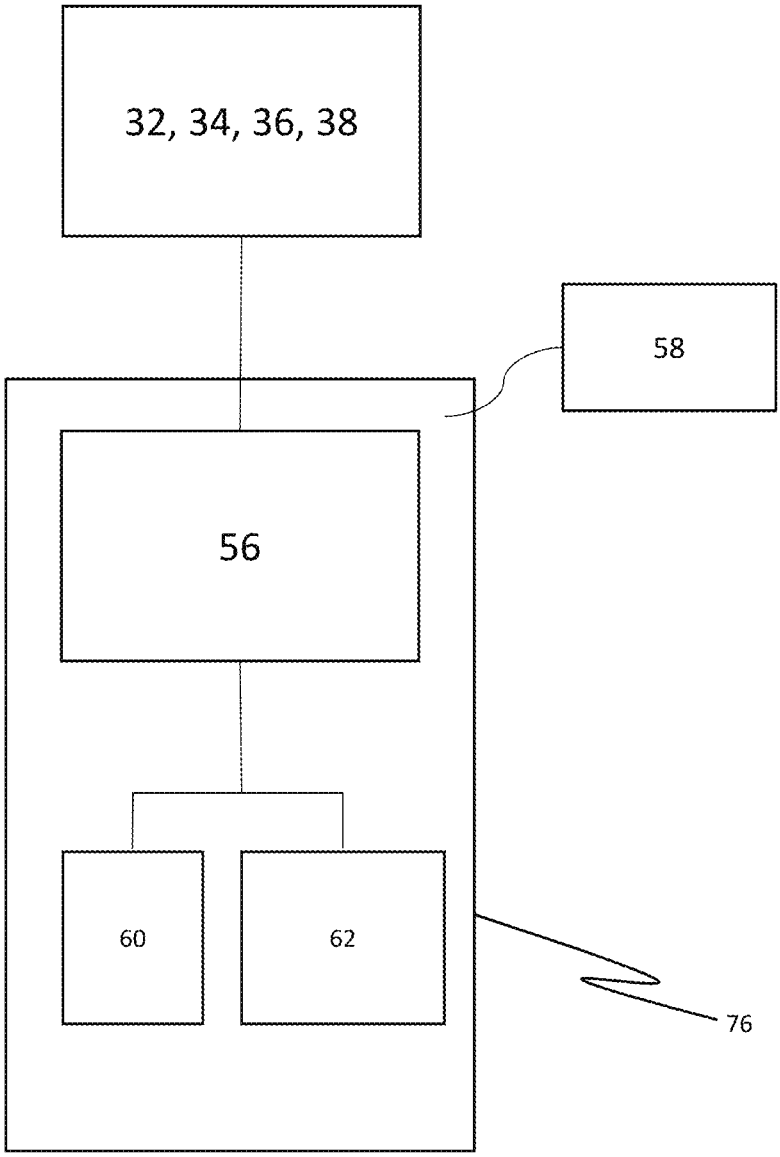
FIG. 5 shows the machine learning system.
Figure 6:
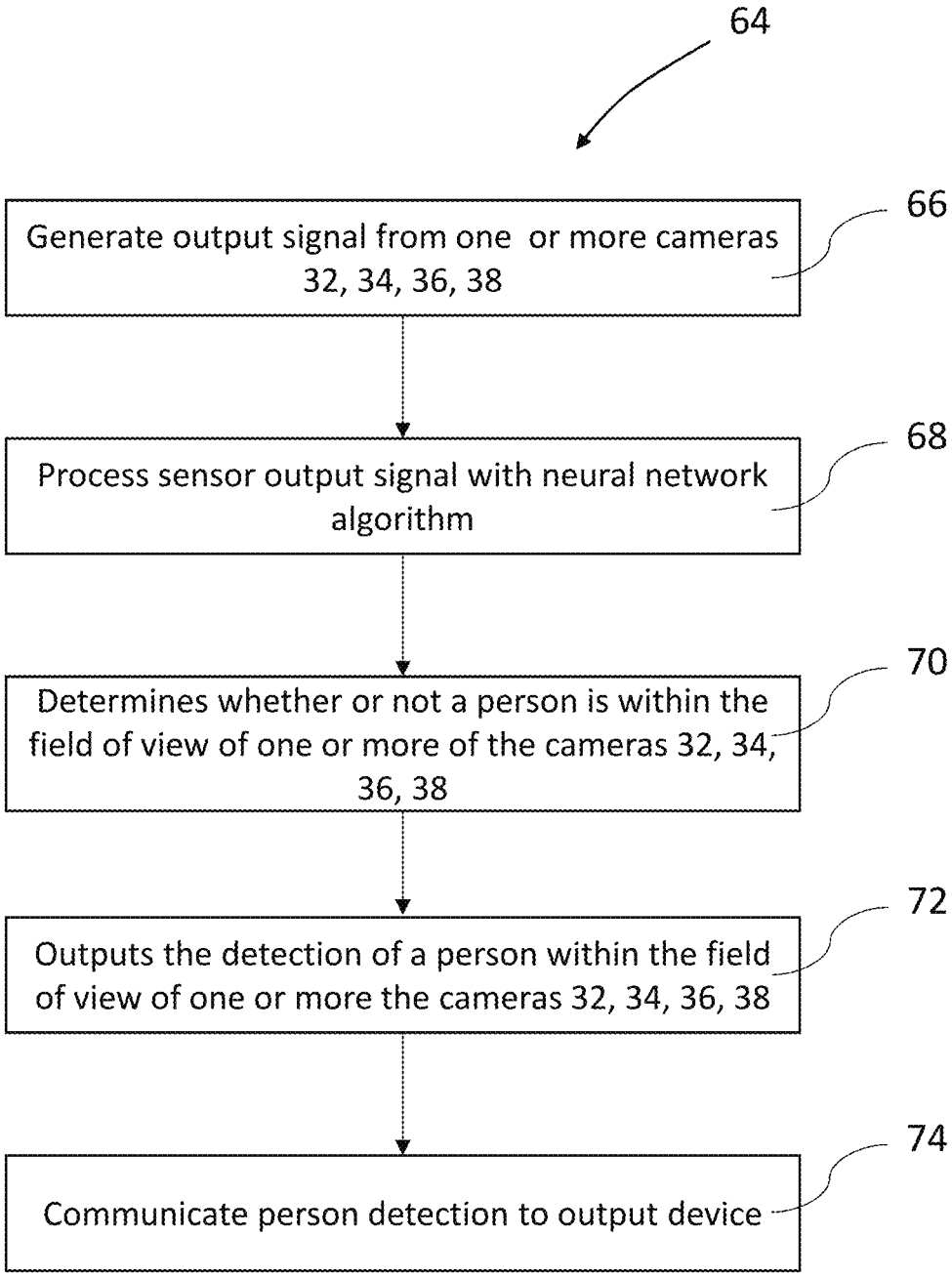
FIG. 6 shows the machine learning process carried out by the processor of the machine learning system in FIG. 5.

Referring now to FIGS. 5 and 6, the control system comprises a processor 56 configured to execute a machine learning algorithm trained to determine whether the detected animate object is an animate object to determine whether an animate object is within the field of view of at least one camera 32, 34, 36, 38 from the camera output signal(s). The control system is configured to provide an output to alert an operator of the working machine 10 if it is determined by the machine learning algorithm that an animate object has been detected in the field of view of at least one camera 32, 34, 36, 38. The control system is configured to provide an output to the display and/or indicators 60, or to an alarm or other device, to alert an operator of the working machine 10 if it is determined that an animate object has been detected in the field of view of at least one camera 32, 34, 36, 38. The control system may also be configured to transmit information relation to the detection of a animate object by one or more of the cameras to a remote location via a transmitter 62. In some arrangements, the control system may be configured to predict a trajectory of movement of a detected animate object and to determine whether or not a collision is likely to occur based on this determination. In alternative arrangements, it will be appreciated that the machine learning algorithm may be omitted, and the control system may be configured to determine whether an objected detected by one or more of the at least one cameras is an animate object, and to generate an output as has been discussed above.

The working machine may include an operator input (e.g. via a touchscreen input on the display 60). The control system 76 may include a memory (not shown). An operator may be able to input a failure to detect an animate object and/or an incorrect determination of a animate object by the machine learning algorithm into the control system via the operator input so as to be stored on the memory. This input from the operator may be used to improve the training of the algorithm on a remote electronic device. Subsequent to this, an improved machine learning algorithm may then be loaded onto the memory of the control device.

The machine learning algorithm comprises a neural network 58. The neural network system 58 includes the processor 56 which receives output signals from the cameras 32, 34, 36, 38. The processor 56 executes a neural network process, shown in more detail in FIG. 6. The neural network 58 is capable of performing pattern recognition, and the neural network is able to determine whether the detected animate object is an animate object based on this pattern recognition.

FIG. 6 illustrates the neural network process 64 which is carried out by the processor 56 in the neutral network system 58. An output signal is generated by one or more of the cameras 32, 34, 36, 38 when an object is detected by one or more of the cameras 32, 34, 36, 38 at step 66. At step 68, the camera output signal(s) is received and processed by a neural network 58 that has previously been trained to determine whether or not a animate object is within the field of view of one or more of the cameras 32, 34, 36, 38 from output signals from said cameras 32, 34, 36, 38. The neural network 58 determines whether or not a animate object is within the field of view of one or more the cameras 32, 34, 36, 38 at step 70. The neural network 58 outputs the detection of an animate object at step 72 and, at step 74, whether or not a animate object has been detected by one or more of the cameras 32, 34, 36, 38 is communicated to an output device (such as a display/indicator/alarm 60, the memory (not shown), and/or transmitted to a further device at a remote location).

It is desirable to train the neural network 58 over a wide range of different working environments, and to perform the animate object detection under a wide range of different conditions. It will be understood that the training of the neural network 58 includes training in a range of different locations and weather conditions and temperatures.

Although the teachings have been described above with reference to one or more preferred embodiments, it will be appreciated that various changes or modifications may be made without departing from the scope as defined in the appended claims.

The invention claimed is:

1. A working machine comprising:

a body including an operator cab from which an operator can operate the working machine;

a ground engaging propulsion structure supporting the body; a working arm mounted to the body;

a control system;

a collision avoidance system comprising a plurality of cameras mounted on the body of the working machine, each camera configured to monitor an area in a field of view of the camera and to generate a camera output signal to the control system in response to a detected object in said field of view; and a display configured to display camera output signals from the plurality of cameras, wherein the control system is configured to divide the camera output signals into a plurality of zones independently of mounted positions of the cameras, to assign the camera output signals to the plurality of zones, and to display at least one zone on the display, wherein the control system comprises a processor configured to execute a machine learning algorithm trained to determine whether the detected object is an animate object to determine whether the animate object is within the field of view of at least one camera from the camera output signal, and wherein the control system is configured to provide an output for alerting said operator in the operator cab if it is determined that the animate object has been detected in the field of view of the at least one camera, and wherein the working machine comprises an operator input positioned within the operator cab, wherein the control system comprises a memory, and wherein, in use, the operator of the working machine can input an indication of failure to detect the animate object and/or an incorrect determination of the detected animate object via the operator input positioned within the operator cab so as to be stored on the memory of the control system of the working machine for use in improving training of the machine learning algorithm, and wherein the body comprises an undercarriage and a superstructure rotatably mounted on the undercarriage, wherein the plurality of cameras are mounted on the rotatable superstructure or the undercarriage, and wherein the control system is configured to select, via the operator input, whether displayed zones remain fixed relative to the undercarriage or remain fixed relative to the superstructure.

2. The working machine according to claim 1, wherein the control system is configured to provide the output for alerting the operator if it is determined that the animate object has been detected in at least one zone.

3. The working machine according to claim 2, wherein, when the animate object is detected in the at least one zone and is determined to be at a greater distance from the working machine than a predetermined threshold distance, the control system is configured to provide a first, or low, risk warning, and when the animate object is detected within the at least one zone and is determined to be within the predetermined threshold distance from the working machine, the control system is configured to provide a second, or high, risk warning.

4. The working machine according to claim 2, wherein, when it is determined that the animate object and at least one further animate object have been detected in at least two zones, the control system is configured to assign a collision risk level to each detected animate object and to prioritize the zone or zones to display on the display based on the assigned collision risk levels.

5. The working machine according to claim 4, wherein the control system is configured to prioritize the zone to display based on one or more of: a position of the detected animate objects relative to a direction of travel of the working machine; a proximity of the detected animate objects to the working machine; the most recently detected animate object; and/or a number of animate objects detected in each danger zone.

6. The working machine according to claim 4, wherein the control system is configured to assign a first, or highest, level of priority to the zone based on a position of the detected animate objects relative to a direction of travel of the working machine.

7. The working machine according to claim 6, wherein the control system is configured to assign a second level of priority, below the first level of priority, based on a proximity of the detected animate objects to the working machine.

8. The working machine according to claim 1, wherein the control system is configured to provide a warning, alert, or notification on the display in relation to the detected animate object not displayed on the display.

9. The working machine according to claim 1, wherein, when it is determined that the animate object has been detected in the field of view of at least two of the plurality of cameras, the control system is configured to select a camera output signal from one or more of the at least two cameras to display on the display.

10. The working machine according to claim 9, wherein the camera output signal to be displayed is selected based on one or more of: a direction of movement of the working machine; a proximity of the animate object detected by the plurality of cameras; the most recently detected animate object; a determined trajectory of the detected animate object; and/or a number of animate objects detected by each camera.

11. The working machine according to claim 1, comprising the display configured to operate in a plurality of display modes comprising a camera display mode in which the display is configured to display an output from one or more of the plurality of cameras and at least one other display mode, wherein, when it is determined that the animate object has been detected in the field of view of the at least one camera, the control system is configured to override a selection of the at least one other display mode to activate the camera display mode.

12. The working machine according to claim 1, wherein the working machine comprises a first override control such that one or more of the plurality of cameras can be deactivated by the operator of the working machine via the control system, and/or wherein the working machine comprises a second override control such that an output generated in response to the animate object being detected is able to be deactivated.

13. The working machine according to claim 1, wherein the output for alerting the operator from the control system comprises activating an indicator or activating an alarm, wherein the working machine comprises an array of indicators arranged within the operator cab, and wherein the control system is configured to indicate a position of the detected animate object relative to the operator cab via the array of indicators.

14. The working machine according to claim 13, wherein the array of indicators are arranged within the operator cab such that at least one indicator is positioned at each of front, rear, right side and left side positions of the operator cab.

15. The working machine according to claim 1, wherein the working machine comprises the display positioned within the operator cab, the display being configured to display the camera output signals from the plurality of cameras, and wherein the operator input is on the display.

16. The working machine according to claim 1, wherein the control system is configured to provide said output for alerting said operator during traveling of the working machine initiated by said operator controlling the ground engaging propulsion structure to move the working machine from one location to another.

17. A working machine comprising:

a body comprising an undercarriage and a superstructure rotatably mounted on the undercarriage;

a ground engaging propulsion structure supporting the body;

a working arm mounted to the body;

a display;

a control system; and a collision avoidance system comprising a plurality of cameras mounted on the superstructure or the undercarriage of the body of the working machine and configured to monitor an area in a field of view of a camera and to generate a camera output signal to the control system, wherein the control system comprises a processor configured to define a plurality of zones, to assign camera output signals of the plurality of cameras to the plurality of zones, and to display one or more of the plurality of zones on the display, wherein the control system is configured to provide an output for alerting an operator if it is determined that an animate object has been detected in at least one zone, wherein the plurality of zones are defined independently of mounted positions of the plurality of cameras, and wherein the control system is configured such that the plurality of zones can be fixed relative to the undercarriage and such that the plurality of zones can be fixed relative to the superstructure, and wherein the control system is configured to enable the operator to select, via an operator input, whether the displayed zones remain fixed relative to the undercarriage or remain fixed relative to the superstructure.

18. A working machine of claim 17, wherein the plurality of zones are defined in relation to one or more of a group comprising a front, a first side, a second side and a rear of the working machine.

* * * * *